US009096966B2

(12) United States Patent
Kaltofen

(10) Patent No.: US 9,096,966 B2
(45) Date of Patent: Aug. 4, 2015

(54) DEVICE AND METHOD FOR DETERMINING A FILL LEVEL WITHIN A SUDS TUB OF A WASHING MACHINE

(75) Inventor: Thomas Kaltofen, Berlin (DE)

(73) Assignee: BSH Hausgerãte GmbH, Munich (DE)

( * ) Notice: Subject to any disclaimer, the term of this patent is extended or adjusted under 35 U.S.C. 154(b) by 1141 days.

(21) Appl. No.: 12/672,526

(22) PCT Filed: Aug. 14, 2008

(86) PCT No.: PCT/EP2008/060702

§ 371 (c)(1),
(2), (4) Date: Feb. 8, 2010

(87) PCT Pub. No.: WO2009/027242

PCT Pub. Date: Mar. 5, 2009

(65) Prior Publication Data

US 2011/0023919 A1 Feb. 3, 2011

(30) Foreign Application Priority Data

Aug. 24, 2007 (DE) ..... 10 2007 040 080

(51) Int. Cl.

| | |
|---|---|
| ***D06F 33/00*** | (2006.01) |
| ***D06F 39/08*** | (2006.01) |
| ***A47L 15/42*** | (2006.01) |
| ***D06F 37/26*** | (2006.01) |

(52) U.S. Cl.

CPC ..... *D06F 39/087* (2013.01); *A47L 15/4244* (2013.01); *A47L 15/4246* (2013.01); *D06F 37/267* (2013.01); *Y10T 137/0324* (2015.04); *Y10T 137/729* (2015.04)

(58) Field of Classification Search

CPC ..... A47L 15/4244; D06F 39/087
USPC ..... 68/12.05, 12.21
See application file for complete search history.

(56) References Cited

U.S. PATENT DOCUMENTS

| | | | | |
|---|---|---|---|---|
| 2,565,150 | A | 8/1951 | Stageberg | |
| 2,656,431 | A | 10/1953 | Bochan | |
| 3,153,924 | A | 10/1964 | Alger | |
| 3,496,775 | A * | 2/1970 | Sargent | 73/384 |
| 4,951,236 | A * | 8/1990 | Kawate et al. | 702/98 |
| 5,461,922 | A * | 10/1995 | Koen | 73/756 |
| 5,878,602 | A | 3/1999 | Kovich et al. | |
| 6,901,777 | B2 | 6/2005 | Bolduan et al. | |
| 2002/0088061 | A1 * | 7/2002 | Kown | 8/158 |
| 2003/0115965 | A1 * | 6/2003 | Mittelstein et al. | 73/706 |
| 2004/0206132 | A1 * | 10/2004 | Lyu | 68/12.03 |
| 2005/0034491 | A1 * | 2/2005 | Tazawa et al. | 68/12.03 |

FOREIGN PATENT DOCUMENTS

| | | |
|---|---|---|
| CA | 2313313 C | 4/2005 |
| DE | 1485100 | 1/1970 |
| DE | 4231849 A1 | 6/1993 |
| DE | 4141213 C2 | 12/1996 |

(Continued)

*Primary Examiner* — David Cormier
(74) *Attorney, Agent, or Firm* — Nixon & Vanderhye, P.C.

(57) ABSTRACT

A device for determining a fill level of liquid within a suds tub of a washing machine, having a fill level sensor by means of which a pressure value generated by the liquid can be determined, the fill level sensor having at least one detection part disposed in a lower area of the suds tub that is covered by the liquid during the washing process.

13 Claims, 2 Drawing Sheets

(56) References Cited

FOREIGN PATENT DOCUMENTS

| | | | |
|---|---|---|---|
| DE | 19835865 | A1 | 2/1999 |
| DE | 4447696 | C2 | 7/1999 |
| DE | 19821148 | A1 | 11/1999 |
| DE | 10031039 | A1 | 12/2001 |
| EP | 48607 | A1 * | 3/1982 |
| EP | 1087052 | A2 | 3/2001 |
| WO | 9516067 | A1 | 6/1995 |

* cited by examiner

DEVICE AND METHOD FOR DETERMINING A FILL LEVEL WITHIN A SUDS TUB OF A WASHING MACHINE

This application is a U.S. National Phase of International Patent Application No. PCT/EP2008/060702, filed Aug. 14, 2008, which designates the U.S. and claims priority to German Patent Application No. DE 10 2007 040 080.4, filed Aug. 24, 2007, the entire contents of each of which are hereby incorporated by reference.

BACKGROUND OF THE INVENTION

The invention relates to a device and also to a method for determining a fill level within a suds tub of a water-conducting machine.

The variable fill level or the variable liquid level within a container, also referred to below as the tub, of a washing machine is usually measured nowadays using a column of air which is connected to the liquid to be found within the tub. Consequently a change in the fill level or liquid level leads to a change in the air pressure or air volume which occurs between the liquid of the tub and a fill level sensor embodied as a pressure sensor. The fill level within the tub is thus determined as a function of the height of the air column within the tub.

Such a device or such a method are for example already to be taken as known from EP 1 341 955 B1. In the washing machine described therein a pressure line is arranged in a drain hose and is located in an area below the tub which is in contact with the liquid or the washing liquor. The actual fill level sensor in this case is arranged above the tub in order to detect the corresponding fill level of liquid within the tub from the change in the column of air.

EP 1 087 052 A2 discloses a washing machine with a fill level sensor which is arranged on the tub and is connected via a pressure hose to the drain hose. An acceleration sensor and a temperature sensor are also arranged in the housing of the fill level sensor.

Further devices for determining a fill level of liquid within a container of a water-conducting domestic appliance are known from DE 1 485 100 A, U.S. Pat. Nos. 3,153,924 A and 2,656,431 A. These devices contain a fill level sensor and an elastic and pressure-transmission membrane which is connected to the housing of the fill level sensor and is in direct contact with the liquid. The membrane is arranged in a lower area of the tub.

BRIEF SUMMARY OF THE INVENTION

An object of the present invention is to create a device and a method of the type mentioned at the start with which an extremely robust determination of the fill level of the liquid within the tub can be carried out.

To be able to carry out an extremely robust detection of the fill level of the liquid within the tub, there is inventive provision for at least a detection part of the fill level sensor to be arranged in a lower area of the tub covered by the liquid during the washing process. In other words there is inventive provision for the fill level to be measured directly by the column of air formed by the liquid level of the tub by the fill level sensor, especially embodied as a pressure sensor, being arranged at least with its detection part in contact with the liquid in the tub. It is clear that for this purpose the detection part of the fill level sensor must be arranged in the corresponding lower area of the tub so that a reliable coverage with the liquid during the washing process is guaranteed. Washing process in this case is not be understood just as the rotation of a washing drum within the tub, but as any state in which the liquid is to be found within the tub.

The arrangement of at least the detection part of the fill level sensor directly within or in contact with the liquid has the advantage in this case that the direct linkage to the tub and the use of the large volume of the liquid means that the detection or output signal of the fill level sensor is far less sensitive to short-duration pressure peaks which arise as a result of the washing mechanics or the washing turning within the tub. A further advantage of the direct integration of the fill level sensor into the tub is that a plurality of components for passing on pressure or for generating a column of air can now be dispensed with. Overall this produces an especially low-cost facility for determining the fill level within the tub of the washing machine.

In a further embodiment of the invention it has also been shown to be advantageous for a determination device to be provided, by means of which the fill level of the liquid is to be determined based on the pressure value detected by the fill level sensor. In this case for example a conversion of the pneumatic pressure value into a continuously changeable analog output signal, for example an electrical dc voltage, is undertaken, which can be further processed in the simple manner in the controller of the washing machine.

It has also been shown to be advantageous for the detection part of the fill level sensor to comprise a planar sensor element which is covered by an elastic and pressure-transmission membrane. Such a membrane thus initially has a protective function in order to protect the actual sensor element of the fill level sensor from the liquid. The corresponding elastic properties of the membrane, which is preferably designed as a fairly large-format membrane, mean that an almost error-free transmission of pressure to the planar sensor element of the fill level sensor is achieved. In other words the membrane serves both for pressure transmission and also as a protection against media in direct contact with an electrically-conducting liquid.

In addition it is advantageous for the membrane to be arranged to form an enclosed space at a distance from the planar sensor element. The pressures or pressure differences detected by the membrane are thus passed on via the space to the planar sensor element of the fill level sensor. The enclosed space between the membrane and the planar sensor element in this case is typically filled with the gas, and especially with air. This achieves an especially good transmission of pressure between the membrane and the planar sensor element of the fill level sensor.

The membrane in this case, in a further embodiment of the invention, is typically embodied as a pressure-transmission membrane which is held on a sensor housing of the fill level sensor. In this case corresponding seals can be provided in order to keep the space between the membrane and the sensor element dry.

In an alternate embodiment it is however also conceivable for the membrane to be defined as a one-piece protective membrane with a sensor housing of the fill level sensor. A sealing of the space between the membrane and the planar sensor element of the fill level sensor is thus obtained in an especially simple manner.

The pressure sensor or fill level sensor, in a further embodiment of the invention, is additionally equipped with a temperature sensor in order to detect the temperature of the liquid within the tub. In order to obtain an especially simple device, in a further embodiment of the invention the temperature value of the liquid is determined by means of the determination device present in any event. Instead of the temperature sensor or in addition to it, the pressure sensor or fill level sensor can be equipped with the further sensors detecting a property of the liquid. For example the pressure sensor or fill level sensor can be an optical sensor which comprises a light source and a light-sensitive element, for detecting the turbidity of the liquid. The light source and the receive element are arranged in the pressure sensor or fill level sensor in such a way that the light sent out streams through an area of the liquid and the remaining light intensity is detected by the receive element. This enables the number of components within the washing machine to be reduced in a cost-effective manner.

Finally the use of a piezoresistive, capacitive or inductive fill level sensor in particular has proved to be advantageous for the conversion of the pressure signals into electrical signals. These fill level sensors are characterized by a precise measurement and a corresponding robustness.

The advantages explained above in conjunction with the inventive device apply in equal measure to the inventive method. This is characterized especially by the fact that the pressure value generated by the liquid is detected by direct contact of a detection part of the fill level sensor with the liquid. Once again this produces the advantages already described, namely a far less sensitive measurement in relation to pressure peaks during the washing process and a significantly lower-cost option for measuring the fill level of liquid or washing liquor within the tub.

BRIEF DESCRIPTION OF THE DRAWINGS

Further advantages, features and details of the invention emerge from the subsequent description of an exemplary embodiment as well as with reference to the drawings. These drawings show in FIG. 1 a schematic front view of a washing machine with a tub within which a rotating washing drum is arranged, with a fill level sensor being indicated schematically in the lower area of the tub which projects into the tub with a detection part and which, during the washing process, lies with its detection part below the level of the liquid or of the washing liquor within the tub.

DETAILED DESCRIPTION OF EXEMPLARY EMBODIMENTS OF THE PRESENT INVENTION

Figure 1:
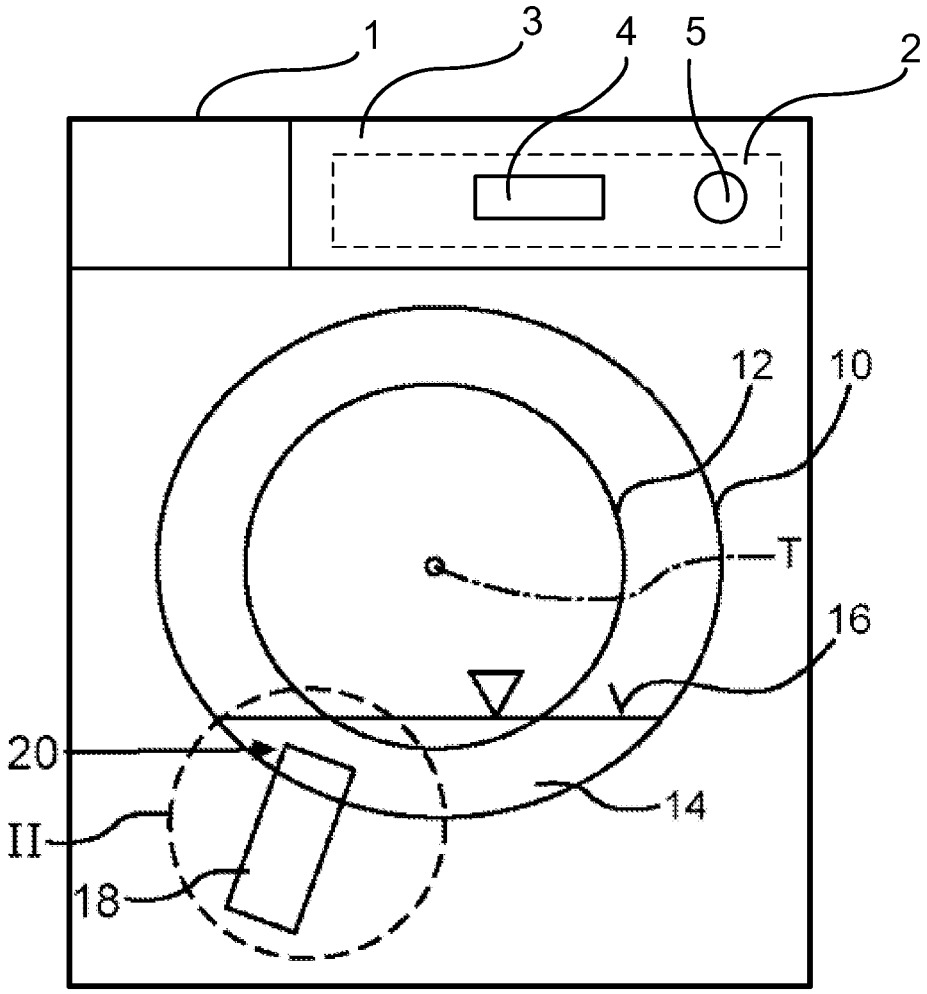

FIG. 1 shows a schematic front view of a tub 10 of a washing machine 1. In the upper part of the washing machine is arranged a control panel 3 with a rotary selection dial 5 and a display 4. Behind the control panel a controller 2 which is at least electrically connected to the display 4 and the rotary selection dial 5, is schematically depicted by a dashed line. Within the tub 10, which has a cylindrical cross-section, is accommodated an inner drum or washing drum 12 which is rotated around a drum axis T during washing. Furthermore it can be seen in FIG. 1 that the tub 10 is filled with a liquid 14 or with a washing liquor. A fill level 16 or level is marked accordingly.

Within the tub 10 is arranged a fill level sensor in the form of a pressure sensor 18 with a detection part 20. This arrangement is especially evident when viewed together with FIG. 2.

Figure 2:
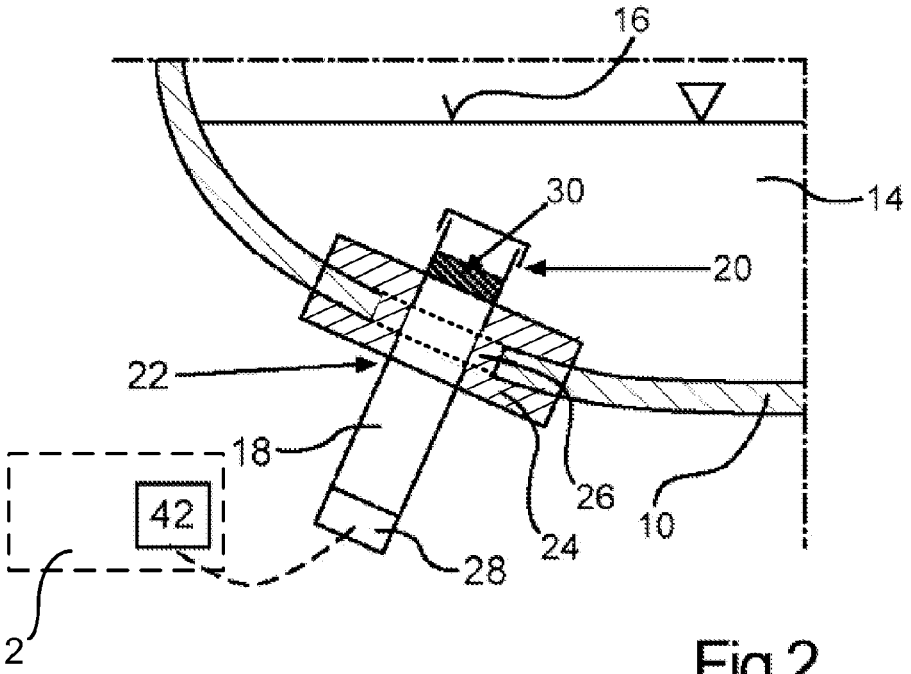
FIG. 2 a schematic and sectionally-enlarged front view of the fill level sensor with its detection part integrated into the tub in accordance with detail II in FIG. 1.

To this end FIG. 2 shows a sectional enlarged front view or sectional view of the detail II as indicated in FIG. 1. It can especially be seen here that the fill level sensor 18 in this example is not arranged entirely within the tub 10, but instead only has its detection part 20 within the tub. It should also be considered however as being included within the framework of the invention that the fill level sensor 18 could be arranged at least almost completely within the tub 10.

It can also be seen from FIGS. 1 and 2 that the detection part 20 of the fill level sensor 18 is arranged in a lower area 22 of the tub 10 which is reliably covered during the washing process or during the filling of the tub 10 accordingly by the liquid or the washing liquor. In the present exemplary embodiment a seal 24 can be seen, by means of which a through-opening 26 (dashed line) within the wall of the tub 10 is sealed from the fill level sensor 18. It can also be seen from FIG. 2 that a so-called RAST 2.5 connector 28 is arranged outside the tub 10 on the fill level sensor 18, serving here to electrically forward the values or signals detected by the fill level sensor 18 to a determination device 42 and/or to the controller 2 of the washing machine 1. In the version shown in FIG. 2 the determination device 42 is a component of the controller 2.

Figure 3:
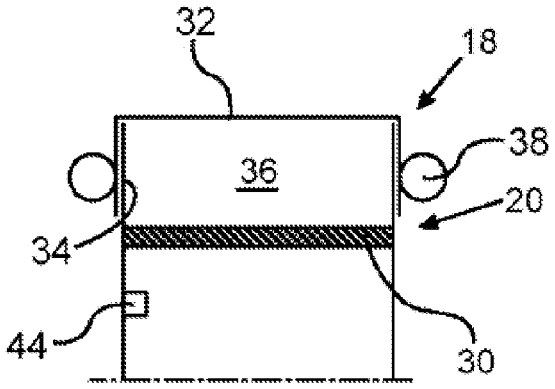
FIG. 3 a schematic and enlarged sectional view of the detection part of the fill level sensor arranged within the tub, which in the present example consists of a planar sensor element which is protected by a plastic pressure-transmission membrane while forming a space, with the pressure-transmission membrane being held as a separate component on a sensor housing of the fill level sensor.
Figure 4:
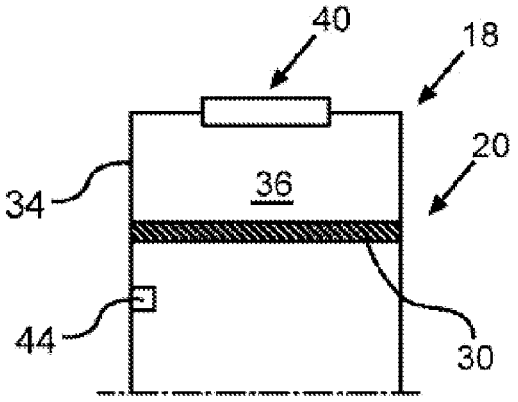
FIG. 4 a schematic and enlarged sectional view of the detection part of the fill level sensor arranged within the tub in an alternate embodiment to that depicted in FIG. 3, with a protective membrane embodied in one piece with the sensor housing while forming a space being arranged at a distance in front of the planar sensor element.

The concrete embodiment of the detection part 20 of the fill level sensor 18 is now to be explained in conjunction with FIG. 2 along with FIGS. 3 and 4. To this end FIG. 3 shows the design of the detection part 20 of the fill level sensor 18 as depicted in FIG. 2 in a schematic sectional view. FIG. 4 shows a sectional view of a detection part 20 of the fill level sensor 18 in an alternate embodiment thereto.

It can be seen that the detection part 20 comprises a planar sensor element which is covered by an elastic and pressure-transmission membrane. This membrane is designed in the embodiment depicted in FIGS. 2 and 3 as a separate pressure-transmission membrane 32, which is held or attached as a separate part on the sensor housing 34 of the fill level sensor 18. It can be seen that the pressure-transmission membrane 32 is arranged to form an enclosed space 36 at a distance from the planar sensor element 30. So that the space 36 is sealed accordingly, in this example a seal 38 in the form of an O-ring is provided which takes care of the corresponding sealing between the pressure-transmission membrane 32 and the sensor housing 34.

In the embodiment depicted in FIG. 4 the membrane is designed as a protective membrane 40 in one piece with the sensor housing 34. In this example the protective membrane 40 is injection molded onto the plastic sensor housing 34. A space 36 between the protective membrane 40 and the planar sensor element 30 can again be seen in this diagram. The space 36 between the respective membrane 32 or 40 and the planar sensor element 30 is filled in this example with gas, especially with air.

It is particularly evident from FIGS. 1 and 2 that the respective fill level 16 is detected in this example by direct measurement of the pressure column formed by the liquid 14 within the tub 10. To this end the membrane 32 or 40 respectively, for pressure transmission and protection from media during direct contact with the electrically-conductive liquid 14, is in immediate contact with said liquid. In other words the fill level sensor 18 is constructed such that the outer contour of the fill level sensor 18 is embodied at the point of direct contact with the liquid 14 as an elastic, pressure-transmission skin (membrane) and transmits the pressure to the actual pressure-converting membrane or to the pressure-converting sensor element 30 within the fill level sensor 18. This transmission is performed especially advantageously if the space 32 is correspondingly filled with a gas or with air. Equally it would naturally also be conceivable to fill the space 36 with another medium.

It can also be seen from FIG. 2 that the fill level sensor is connected to a determination device 42 by means of which the fill level 16 of the liquid 14 is to be determined on the basis of the pressure value detected by the fill level sensor 18. The fill level sensor 18 is embodied in this case as a piezoresistive, capacitive or inductive sensor in order to convert the pneumatic pressure value into a continuously-changeable analog output signal, for example an electrical dc voltage.

In addition a temperature sensor 44, with which the temperature of the liquid 14 is to be detected, can be assigned to the fill level sensor 18. It is clear that the temperature sensor 44 must accordingly be arranged at a position of the fill level sensor 18 in which a temperature contact to the liquid 14 is possible. Temperature values detected by the temperature sensor 44 can for example likewise be determined or evaluated by the determination device 42. The determination device 42 can then forward the values determined to the system controller 2 of the washing machine 1.

It is thus possible to carry out a method for determining the fill level 16 of liquid within the tub 10 with the washing machine during the washing process in which a value induced by the liquid, especially a pressure value, is detected by means of a suitable fill level sensor 18. Detection by means of the fill level sensor 18 is undertaken in this case directly in the prescribed manner within the liquid 14. In particular a direct linkage to the liquid 14 within the tub 10 and the use of the large volume of the liquid is achieved by this method which leads to a much more robust sensor signal since no account is taken of short-duration pressure peaks caused by the washing mechanics of the washing which is turning for example.

The invention is not restricted to use within a laundry washing machine. The invention can equally be applied to other water-conducting domestic appliances, especially a dishwasher. In such cases the tub is also embodied as the dishwashing compartment. In addition the facility for determining a fill level can also be arranged at a component arranged on the liquid container, for example a pump, with the component receiving at least a part of the liquid.

The invention claimed is:

1. A fill level sensor system configured to determine a fill level of a liquid within a container of a washing machine, the fill level sensor system comprising:

a sensor housing arranged in a lower area of the container and projecting through a container wall;

an elastic pressure-transmitting membrane on one end of the sensor housing and in direct contact with the liquid;

a planar pressure converting sensor element in the sensor housing and spaced from the elastic pressure-transmitting membrane to define an enclosed space within said housing, said enclosed space filled with a gas, whereby pressure applied to said membrane is transmitted through the gas in said enclosed space to said sensor element; and a controller;

wherein said planar pressure converting sensor element provides an output signal to said controller, and wherein said controller is adapted to determine the fill level of the liquid in the container based upon said output signal.

2. The fill level sensor of claim 1, wherein the elastic pressure-transmitting membrane is attached to the sensor housing.

3. The fill level sensor of claim 1, wherein the elastic pressure-transmitting membrane forms one-piece with the sensor housing.

4. The fill level sensor of claim 3, wherein the sensor housing comprises plastic and the elastic pressure-transmitting membrane comprises an injected-molded elastic pressure-transmitting membrane on the sensor housing.

5. The fill level sensor of claim 1, wherein the gas comprises air.

6. The fill level sensor of claim 1, further comprising a temperature sensor that detects a temperature of the liquid.

7. The fill level sensor of claim 6, wherein the temperature sensor is positioned on the sensor housing so as to contact the liquid and wherein the controller is adapted to determine the temperature of the liquid based upon a temperature value from the temperature sensor.

8. The fill level sensor of claim 1, wherein the planar pressure converting sensor element comprises a piezoresistive, capacitive, or inductive sensor.

9. A method for determining a fill level of a liquid within a container of a washing machine, the method comprising:

arranging a sensor housing containing a fill level sensor in a lower area of the container, the sensor housing projecting through a wall of the container;

covering a first end of the sensor housing with an elastic pressure-transmitting membrane;

arranging the first end of the sensor housing such that the first end is in direct contact with the liquid during operation;

arranging a planar pressure detector in the sensor housing and spaced from the elastic pressure-transmitting membrane to define an enclosed space, the enclosed space filled with a gas;

passing a pressure exerted on the elastic pressure-transmitting membrane to the planar pressure detector via the gas in the enclosed space;

detecting the pressure with the planar pressure detector; and determining the fill level of liquid in the container of the washing machine based upon the pressure detected by the planar pressure detector.

10. The method of claim 9, further comprising detecting a property of the liquid with a further sensor assigned to the fill level sensor.

11. The method of claim 10, wherein the further sensor. comprises a temperature sensor with which the temperature of the liquid is detected.

12. A laundry washing machine, comprising:

a tub;

a washing drum located within said tub;

a fill level sensor that comprises:

a sensor housing located in a lower area of said tub and passing through a wall of the tub;

an elastic pressure-transmitting membrane covering one end of the sensor housing, said one end projecting into said tub such that said membrane is in direct contact with a liquid in said tub;

a planar pressure detector in the sensor housing and spaced from the elastic pressure-transmitting membrane to define an enclosed space filled with a gas, whereby pressure applied to said membrane is transmitted through the gas in said enclosed space to said detector; and a controller adapted to receive an output signal from said planar pressure detector and to convert said output signal to a fill level of the liquid in said tub.

13. A dishwashing machine, comprising:

a tub;

a fill level sensor having:

a sensor housing located in a lower area of said tub and passing through a wall of the tub;

an elastic pressure-transmitting membrane covering one end of the sensor housing, said one end projecting into said tub such that said membrane is in direct contact with a liquid in said tub;

a planar pressure detector in the sensor housing and spaced from the elastic pressure-transmitting membrane to define an enclosed space filled with a gas, whereby pressure applied to said membrane is transmitted through the gas in said enclosed space to said detector; and a controller adapted to receive an output signal from said planar pressure detector and to convert said output signal to a fill level of the liquid in said tub.

* * * * *